US012698917B2

(12) United States Patent
Xu et al.

(10) Patent No.: US 12,698,917 B2
(45) Date of Patent: Aug. 4, 2026

(54) COOLING SYSTEM AND PRETREATMENT MODULE THEREFOR

(71) Applicant: Carrier Corporation, Palm Beach Gardens, FL (US)

(72) Inventors: Hui Xu, Shanghai (CN); Runfu Shi, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 86 days.

(21) Appl. No.: 18/601,299

(22) Filed: Mar. 11, 2024

(65) Prior Publication Data

US 2024/0310069 A1 Sep. 19, 2024

(30) Foreign Application Priority Data

Mar. 13, 2023 (CN) ..... 202310265786.9

(51) Int. Cl.
*F24F 11/65* (2018.01)
*F24F 3/14* (2006.01)
(Continued)

(52) U.S. Cl.
CPC ..... *F24F 11/65* (2018.01); *F24F 3/14* (2013.01); *F24F 5/0035* (2013.01); *F24F 11/84* (2018.01)

(58) Field of Classification Search
CPC .... F24F 11/65; F24F 11/84; F24F 3/14; F24F 3/1411; F24F 3/1429; F24F 5/0035; F24F 2203/02
See application file for complete search history.

(56) References Cited

U.S. PATENT DOCUMENTS 4,430,864 A 2/1984 Mathiprakasam
2006/0053823 A1* 3/2006 Taras ..... F25B 13/00 62/324.1

(Continued)

FOREIGN PATENT DOCUMENTS

WO 2022248995 A1 12/2022

OTHER PUBLICATIONS

Muhammad Wakil Shahzad et al: "An improved indirect evaporative cooler experimental investigation", Science Publishers, GB, vol. 256, Oct. 1, 2019, ISSN: XP085871493, 0306-2619, Elsevier Ltd, 7 pages.

(Continued)

*Primary Examiner* — Miguel A Diaz
(74) *Attorney, Agent, or Firm* — Drew Folgmann

(57) ABSTRACT

A pretreatment module comprises: a first airflow path and a second airflow path, wherein the first airflow path is provided with a first dehumidification heat exchanger, and the second airflow path is provided with a second dehumidification heat exchanger; and a pipeline and valve assembly, wherein, a second end of the first airflow path and a second end of the second airflow path are connected to an air inlet and an air outlet of a natural cooling device of the cooling system through the pipeline and valve assembly; wherein, the pipeline and valve assembly is configured to switch between a first mode and a second mode; in the first mode, the pipeline and valve assembly is configured to connect the first airflow path to the air inlet; and in the second mode, the pipeline and valve assembly is configured to connect the first airflow path to the air outlet.

10 Claims, 4 Drawing Sheets

(51) Int. Cl.
*F24F 5/00* (2006.01)
*F24F 11/84* (2018.01)

(56) References Cited

U.S. PATENT DOCUMENTS

| | | | | |
|---|---|---|---|---|
| 2015/0107287 | A1 | 4/2015 | Forkosh | |
| 2023/0408131 | A1* | 12/2023 | Horie | F24F 11/0008 |
| 2024/0369239 | A1* | 11/2024 | Chen | F24F 5/0035 |

OTHER PUBLICATIONS

Extended European Search Report received for EP Application No. 24163184.5, mailed on Aug. 5, 2024, 8 Pages.

* cited by examiner

COOLING SYSTEM AND PRETREATMENT MODULE THEREFOR

CROSS REFERENCE TO RELATED APPLICATIONS

This application claims priority to Chinese Patent Application Number 202310265786.9 filed on Mar. 13, 2023, which is incorporated by reference herein in its entirety.

FIELD OF THE INVENTION

The present invention relates to the field of refrigeration devices, in particular to a pretreatment module for data center heat dissipation and a cooling system configured with the pretreatment module.

BACKGROUND OF THE INVENTION

For data center heat dissipation, refrigeration systems are typically equipped with both the mechanical refrigeration device and natural cooling device. Mechanical refrigeration devices are refrigeration devices based on traditional compressors, while natural cooling devices aim to use ambient air for cooling. When the ambient temperature is relatively low, only natural cooling devices can be adopted to meet the load demand by utilizing the cold air from the outdoor environment. As the ambient temperature increases, natural cooling alone may not be able to meet the cooling demand. In this case, mechanical refrigeration devices and natural cooling devices can be used in combination. As the mechanical refrigeration devices are configured with compressors, the energy consumption of the mechanical refrigeration devices during operation is significantly higher than that of the natural cooling devices.

SUMMARY OF THE INVENTION

The object of the present application is to solve or at least alleviate the problems existing in the prior art.

According to some aspects, the object of the present invention is to solve the problem of high energy consumption ratio of air conditioning in existing cooling systems.

According to one aspect, a pretreatment module for a cooling system is provided, comprising:

a first airflow path and a second airflow path, wherein the first airflow path is provided with a first dehumidification heat exchanger, and the second airflow path is provided with a second dehumidification heat exchanger, where a first end of the first airflow path and a first end of the second airflow path communicate to ambient air; and a pipeline and valve assembly, wherein a second end of the first airflow path and a second end of the second airflow path are connected to an air inlet and an air outlet of a natural cooling device of the cooling system through the pipeline and valve assembly;

wherein, the pipeline and valve assembly is configured to switch between a first mode and a second mode;

in the first mode, the pipeline and valve assembly is configured such that the first airflow path communicates to the air inlet, and the second airflow path communicates to the air outlet; and in the second mode, the pipeline and valve assembly is configured such that the first airflow path communicates to the air outlet, and the second airflow path communicates to the air inlet.

Optionally, in an embodiment of the pretreatment module, the pretreatment module further comprises an additional pipeline and valve assembly, wherein liquid flow paths of the first dehumidification heat exchanger and the second dehumidification heat exchanger are connected to a first liquid port and a second liquid port of the cooling system through the additional pipeline and valve assembly.

Optionally, in an embodiment of the pretreatment module, the additional pipeline and valve assembly is configured such that in the first mode, the liquid flow path of the first dehumidification heat exchanger communicates with the first liquid port and the second liquid port of the cooling system, and the communication from the liquid flow path of the second dehumidification heat exchanger to the first liquid port or the second liquid port of the cooling system is cut off; and in the second mode, the liquid flow path of the second dehumidification heat exchanger communicates with the first liquid port and the second liquid port of the cooling system, and the communication from the liquid flow path of the first dehumidification heat exchanger to the first liquid port or the second liquid port of the cooling system is cut off.

Optionally, in an embodiment of the pretreatment module, the pipeline and valve assembly comprises:

a first branch and a second branch respectively connected from the first airflow path to the air inlet and the air outlet;

a third branch and a fourth branch respectively connected from the second airflow path to the air inlet and the air outlet;

wherein, the first branch is provided with a first valve, the second branch is provided with a second valve, the third branch is provided with a third valve, and the fourth branch is provided with a fourth valve; or a first three-way valve is provided at an intersection of the first airflow path, the first branch, and the second branch, and a second three-way valve is provided at an intersection of the second airflow path, the third branch, and the fourth branch.

Optionally, in an embodiment of the pretreatment module, the additional pipeline and valve assembly comprises:

a first main flow path connected to the first liquid port of the cooling system, a first liquid branch and a second liquid branch respectively connected from the first main flow path to the liquid flow path inlet of the first dehumidification heat exchanger and the liquid flow path inlet of the second dehumidification heat exchanger, a second main flow path connected to the second liquid port of the cooling system, and a third liquid branch and a fourth liquid branch respectively connected from the second main flow path to the liquid flow path outlet of the first dehumidification heat exchanger and the liquid flow path outlet of the second dehumidification heat exchanger;

wherein, one of the first liquid branch and the third liquid branch includes a first shut-off valve, and one of the second liquid branch and the fourth liquid branch includes a second shut-off valve; or a third three-way valve is provided at an intersection of the first main flow path, the first liquid branch, and the second liquid branch, and a fourth three-way valve is provided at an intersection of the second main flow path, the third liquid branch, and the fourth liquid branch.

Optionally, in an embodiment of the pretreatment module, a first driving device, such as a first pump, is provided on a pipeline near the air inlet, where the first driving device draws ambient air into the natural cooling device.

Optionally, in an embodiment of the pretreatment module, a second driving device, such as a second pump, is provided on a pipeline near the air outlet, where the second driving device discharges air from the natural cooling device to the environment.

Optionally, in an embodiment of the pretreatment module, either the first main flow path or the second main flow path includes a third driving device, such as a third pump, where the third driving device drives the liquid cooling medium to circulate.

According to another aspect, a cooling system is also provided, comprising: the pretreatment module according to the embodiments and a natural cooling device connected to the pretreatment module, wherein the natural cooling device comprises a direct evaporative cooling device and/or an indirect evaporative cooling device.

Optionally, in an embodiment of the cooling system, the natural cooling device is configured to cool air entering from the air inlet through direct evaporative cooling and indirect evaporative cooling with the liquid cooling medium from the second liquid port and transport the air to a load.

Optionally, in an embodiment of the cooling system, the natural cooling device is configured to cool liquid cooling medium from the second liquid port through direct evaporative cooling with the air entering from the air inlet and transport the liquid cooling medium to the load.

Optionally, in an embodiment of the cooling system, the natural cooling device comprises: a direct evaporative cooling device and an indirect evaporative cooling device, wherein, the liquid cooling medium from the second liquid port sequentially passes through the direct evaporative cooling device and the indirect evaporative cooling device, and is circulated from the first liquid port to the liquid flow path of one of the first dehumidification heat exchanger and the second dehumidification heat exchanger, and absorbing the adsorption heat generated during the dehumidification, where a first part of the airflow from the air inlet is cooled by passing through a dry channel of the indirect evaporative cooling device and is transported to the load, a second part of the airflow from the air inlet or ambient air is discharged after heat and mass exchange with the liquid cooling medium in the direct evaporative cooling device, and a third part of the airflow from the air inlet or ambient air is discharged after heat and mass exchange with the liquid cooling medium in a wet channel of the indirect evaporative cooling device.

Optionally, in an embodiment of the cooling system, the natural cooling device comprises: a first direct evaporative cooling device and a second direct evaporative cooling device, wherein, the liquid cooling medium from the second liquid port is transported to the load after sequentially passing through the first direct evaporative cooling device and the second direct evaporative cooling device, and then is circulated from the first liquid port to the liquid flow path of one of the first dehumidification heat exchanger and the second dehumidification heat exchanger to absorb the adsorption heat generated during the dehumidification, where the ambient air or a part of the airflow from the air inlet is discharged after heat and mass exchange with the liquid cooling medium in the first direct evaporative cooling device, and the airflow from the air inlet is discharged after heat and mass exchange with the liquid cooling medium in the second direct evaporative cooling device.

Optionally, the cooling system further comprises: a mechanical refrigeration device comprising a compressor, a condenser, a throttling device, and an evaporator connected in sequence;

wherein, the cooling system is capable of operating in a natural cooling mode, an auxiliary natural cooling mode, a collaborative refrigeration mode, or a mechanical refrigeration mode, where only the natural cooling device is in operation in the natural cooling mode, the pretreatment module and the natural cooling device operate together in the auxiliary natural cooling mode, the pretreatment module, the natural cooling device, and the mechanical refrigeration device operate together in the collaborative refrigeration mode, and only the mechanical refrigeration device is in operation in the mechanical refrigeration mode.

Optionally, the cooling system determines the operating mode based on ambient temperature and humidity.

Optionally, in an embodiment of the cooling system, the air heated by the load is mixed with optional ambient air, and is then transported to the first dehumidification heat exchanger or the second dehumidification heat exchanger after passing through a condenser in the mechanical refrigeration device.

Optionally, in an embodiment of the cooling system, when in operation, the pretreatment module periodically switches between the first mode and the second mode.

The pretreatment module and cooling system according to the embodiments of the present invention can improve the overall efficiency of the cooling system and reduce its overall energy consumption.

BRIEF DESCRIPTION OF THE DRAWINGS

With reference to the accompanying drawings, the disclosure of the present application will become easier to understand. Those skilled in the art would easily understand that these drawings are for the purpose of illustration, and are not intended to limit the protection scope of the present application. In addition, in the figures, similar numerals are used to denote similar components, where.

DETAILED DESCRIPTION OF EMBODIMENT(S) OF THE INVENTION

Figure 1:
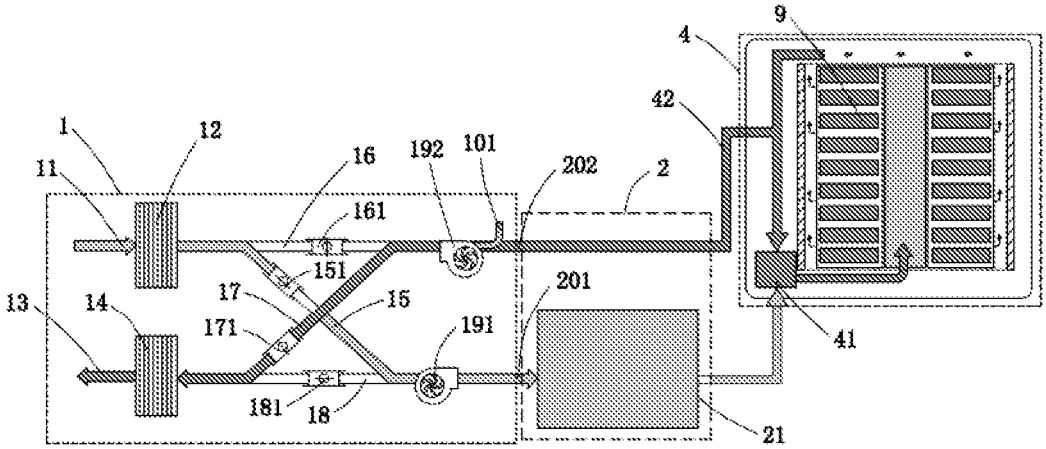
FIGS. 1 and 2 respectively show the schematic diagrams of a cooling system according to an embodiment of the present invention when the pretreatment module is in the first mode and the second mode.
Figure 2:
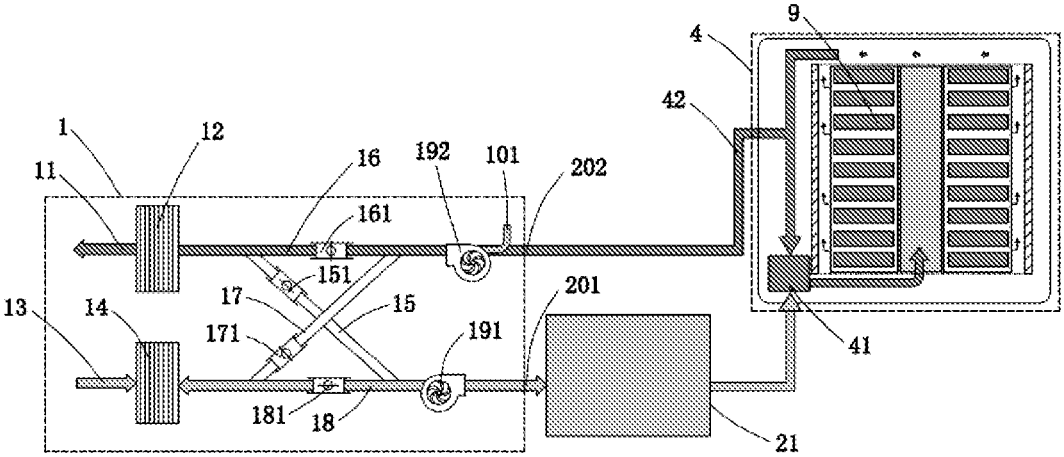

Referring to FIGS. 1 and 2, a cooling system according to an embodiment of the present invention is shown. The cooling system comprises a pretreatment module 1 and a natural cooling device 2 connected to the pretreatment module 1, wherein the natural cooling device 2 is a device based on direct evaporative cooling and/or indirect evaporative cooling for cooling a load 4. In the illustrated embodiment, the load 4 is a data center machine room that includes a plurality of servers 9. Alternatively, the load 4 can be any other device that requires heat dissipation on a long-term basis. When the ambient temperature is sufficiently low, such as in winter, the natural cooling device 2 can be directly adopted to meet the heat dissipation needs of the load 4. For example, ambient air can first be cooled through direct or indirect evaporative cooling in the natural cooling device 2, and then provided to a mixing box 41 in the machine room 4 for circulation in the machine room 4, while the hot air in the machine room 4 is discharged through an outlet channel 42. However, as the ambient temperature increases, the natural cooling device 2 alone may not be able to meet the heat dissipation needs of the machine room 4. In this case, the pretreatment module 1 according to an embodiment of the present invention can be activated to dehumidify the ambient air and supply the dehumidified ambient air to the natural cooling device 2, so as to reduce the temperature of the cooling medium provided to the load 4 through the natural cooling device 2, improve the cooling capacity of the natural cooling device 2, and broaden the applicable ambient temperature and humidity range of the natural cooling device 2, thereby reducing the overall energy consumption of the cooling system.

The pretreatment module 1 comprises: a first airflow path 11, a second airflow path 13, and a pipeline and valve assembly. The first airflow path 11 is provided with a first dehumidification heat exchanger 12, and the second airflow path 13 is provided with a second dehumidification heat exchanger 14. The first end of the first airflow path 11 and the first end of the second airflow path 13 communicate with the ambient air. The second end of the first airflow path 11 and the second end of the second airflow path 13 are connected to an air inlet 201 and an air outlet 202 of the natural cooling device of the cooling system through the pipeline and valve assembly. The pipeline and valve assembly is configured to switch between a first mode as shown in FIG. 1 and a second mode as shown in FIG. 2. In the first mode, the pipeline and valve assembly is configured such that the first airflow path 11 communicates with the air inlet 201 of the cooling system, and the second airflow path 13 communicates with the air outlet 202 of the cooling system. And, in the second mode, the pipeline and valve assembly is configured such that the first airflow path 11 communicates with the air outlet 202 of the cooling system, and the second airflow path 13 communicates with the air inlet 201 of the cooling system. Through this arrangement, one of the first dehumidification heat exchanger 12 and the second dehumidification heat exchanger 14 can be used to reduce the humidity of the introduced ambient air, while the other can be regenerated through the hot air from the load, that is, to remove the moisture adsorbed by the dehumidification heat exchanger and restore its ability to absorb moisture again. Specifically, in the first mode, the first dehumidification heat exchanger 12 plays a dehumidification role, while the second dehumidification heat exchanger 14 is regenerated using the hot air from the load to remove the moisture adsorbed therein. Whereas, in the second mode, the second dehumidification heat exchanger 14 plays a dehumidification role, while the first dehumidification heat exchanger 12 is regenerated using the hot air from the load to remove the moisture adsorbed therein. Therefore, by switching the pretreatment module 1 between the first mode and the second mode, it can be ensured that the pretreatment module 1 continuously supplies dehumidified ambient air to the natural cooling device 2.

In the embodiment shown in the figures, the pipeline and valve assembly comprises: a first branch 15 and a second branch 16 respectively connected from the first airflow path 11 to the air inlet 201 and the air outlet 202, where a first valve 151 and a second valve 161 are respectively provided on the first branch 15 and the second branch 16; and a third branch 18 and a fourth branch 17 respectively connected from the second airflow path 13 to the air inlet 201 and the air outlet 202, where a third valve 181 and a fourth valve 171 are respectively provided on the third branch 18 and the fourth branch 17. Through this arrangement, the switching between the first mode and the second mode can be achieved by controlling the open and close of the first valve, second valve, third valve and fourth valve. For example, in the first mode shown in FIG. 1, the first valve 151 and the fourth valve 171 are opened, and the second valve 161 and the third valve 181 are closed. Whereas, in the second mode shown in FIG. 2, the first valve 151 and the fourth valve 171 are opened, and the second valve 161 and the third valve 181 are closed. Alternatively, the four valves can be replaced by the following arrangement, that is, a first three-way valve is provided at the intersection of the first airflow path 11, the first branch 15 and the second branch 16, and a second three-way valve is provided at the intersection of the second airflow path 13, the third branch 17 and the fourth branch 18. Switching between the first mode and the second mode can also be achieved by controlling the first three-way valve and the second three-way valve. In a further alternative embodiment, the pipeline and valve assembly can have any other suitable arrangement different from that shown in the figures. For example, switching between the first mode and the second mode can be achieved by only configuring a single four-way valve.

Figure 3:
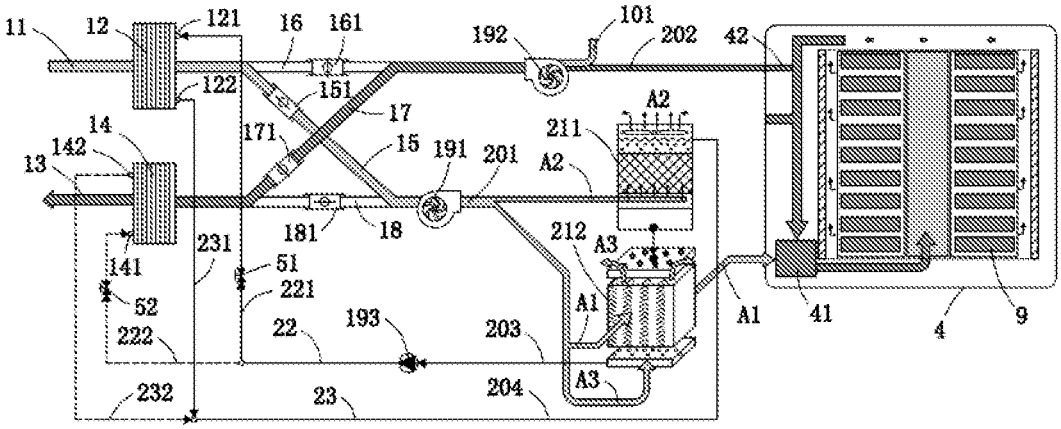
FIG. 3 shows a schematic diagram of a cooling system according to another embodiment of the present invention.

With continued reference to FIG. 3, the pretreatment module further comprises an additional pipeline and valve assembly. The liquid flow paths of the first dehumidification heat exchanger 12 and the second dehumidification heat exchanger 14 are connected to the first liquid port 203 and the second liquid end 204 of the natural cooling device of the cooling system through the additional pipeline and valve assembly. The additional pipeline and valve assembly is configured such that in the first mode, the liquid flow path of the first dehumidification heat exchanger 12 communicates with the first liquid port 203 and the second liquid port 204 of the cooling system, and the communication from the liquid flow path of the second dehumidification heat exchanger 14 to the first liquid port 203 and/or the second liquid port 204 of the cooling system is cut off. In the second mode, the liquid flow path of the second dehumidification heat exchanger 14 communicates with the first liquid port 203 and the second liquid port 204 of the cooling system, and the communication from the liquid flow path of the first dehumidification heat exchanger 12 to the first liquid port 203 and/or the second liquid port 204 of the cooling system is cut off.

In the specific embodiment shown in the figure, the additional pipeline and valve assembly comprises: a first main flow path 22 connected to the first liquid port 203 of the cooling system, a first liquid branch 221 and a second liquid branch 222 respectively connected from the first main flow path 22 to the liquid flow path inlet 121 of the first dehumidification heat exchanger 12 and the liquid flow path inlet 141 of the second dehumidification heat exchanger 14, a second main flow path 23 connected to the second liquid port 204 of the cooling system, and a third liquid branch 231 and a fourth liquid branch 232 respectively connected from the second main flow path 23 to the liquid flow path outlet 122 of the first dehumidification heat exchanger 12 and the liquid flow path outlet 142 of the second dehumidification heat exchanger 14. The first liquid branch 221 and the second liquid branch 222 are respectively provided with a first shut-off valve 51 and a second shut-off valve 52. Alternatively, the first shut-off valve 51 can be provided on the third liquid branch 231. Likewise, the second shut-off valve 52 can be provided on the fourth liquid branch 232. In the first mode, the first shut-off valve 51 is opened while the second shut-off valve 52 is closed. Whereas, in the second mode, the first shut-off valve 51 is closed while the second shut-off valve 52 is opened. In alternative embodiments, a third three-way valve is provided at the intersection of the first main flow path 22, the first liquid branch 221, and the second liquid branch 222, and a fourth three-way valve is provided at the intersection of the second main flow path 23, the third liquid branch 231, and the fourth liquid branch 232. In alternative embodiments, a single four-way valve can also be used to replace two three-way valves. Through this arrangement, the cooling medium flowing through the dehumidification heat exchanger absorbs the adsorption heat generated during the dehumidification, which can further reduce the temperature of the air entering the natural cooling device.

In some embodiments, a first driving device, such as a first pump 191, is provided on the pipeline near the air inlet 201, where the first driving device draws ambient air into the natural cooling device. In some embodiments, a second driving device, such as a second pump 192, is provided on the pipeline near the air outlet 202, where the second driving device discharges air from the natural cooling device to the environment. In some embodiments, one of the first main flow path 22 and the second main flow path 23 includes a third driving device, such as a third pump 193, where the third driving device drives the liquid cooling medium to circulate.

According to another aspect, the present application also provides a cooling system, comprising: the pretreatment module 1 according to the various embodiments, and a natural cooling device 2 connected to the pretreatment module 1, wherein the natural cooling device 2 comprises a direct evaporative cooling device and/or an indirect evaporative cooling device. The natural cooling device 2 is configured to cool the air entering from the air inlet 201 through direct evaporative cooling and indirect evaporative cooling with the liquid cooling medium from the second liquid port 204 and transport the air to the load 4, as is described in detail below in conjunction with FIG. 3, or to cool the liquid cooling medium from the second liquid port 204 through direct evaporative cooling with the air entering from the air inlet 201 and transport the liquid cooling medium to the load 4, as is described in detail below in conjunction with FIG. 4.

In some embodiments, the natural cooling device comprises: a direct evaporative cooling device 211 and an indirect evaporative cooling device 212. The liquid cooling medium from the second liquid port 204 of the cooling system sequentially passes through the direct evaporative cooling device 211 and the indirect evaporative cooling device 212, and is circulated from the first liquid port 203 to the liquid flow path of one of the first dehumidification heat exchanger 12 and the second dehumidification heat exchanger 14 that is in a dehumidification operation, absorbing the adsorption heat generated during the dehumidification. In addition, a first part A1 of the airflow from the air inlet 201 is cooled by passing through the dry channel of the indirect evaporative cooling device 212 and is transported to the load 4. A second part A2 of the airflow from the air inlet is discharged after heat and mass exchange with the liquid cooling medium in the direct evaporative cooling device 211, i.e., discharged to the environment or other suitable places, thereby obtaining cooling medium at a lower temperature. And, a third part A3 of the airflow from the air inlet is discharged after heat and mass exchange with the low-temperature cooling medium from the direct evaporative cooling device 211 in the wet channel of the indirect evaporative cooling device 212. In alternative embodiments, ambient air can be used to heat and mass exchange with liquid cooling medium in the direct evaporative cooling device 211 and the indirect evaporative cooling device 212 and then be discharged, or ambient air can be used in the direct evaporative cooling device 211 and a part of the airflow from the air inlet 201 can be used in the indirect evaporative cooling device 212. In the embodiment shown in FIG. 3, low-temperature cooling medium can be obtained through the direct evaporative cooling device 211, where the low-temperature cooling medium is used to reduce the temperature of the first part A1 of the airflow in the indirect evaporative cooling device 212.

Figure 4:
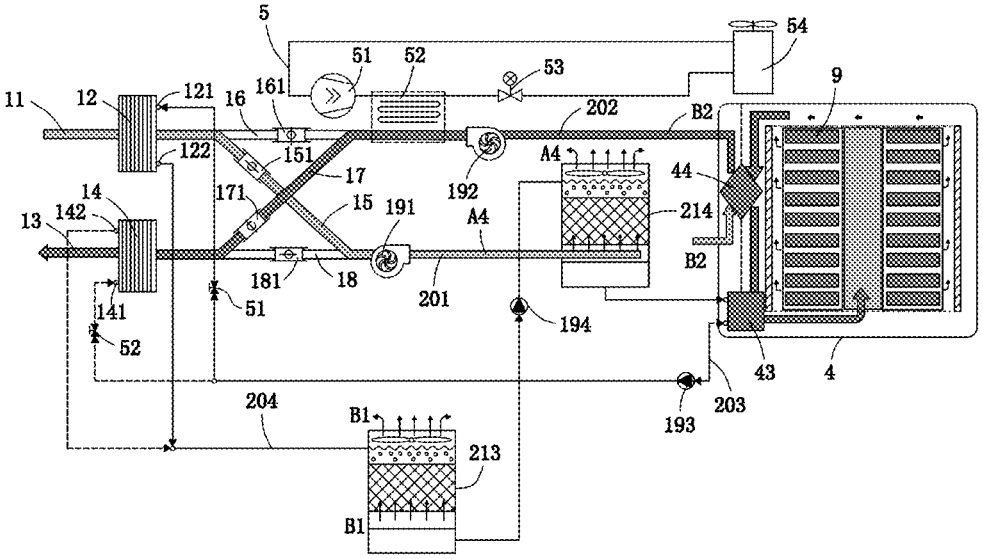
FIG. 4 shows a schematic diagram of a cooling system according to yet another embodiment of the present invention.

With continued reference to FIG. 4, another embodiment of the natural cooling device 2 is shown. In the embodiment of FIG. 4, the natural cooling device 2 comprises: a first direct evaporative cooling device 213 and a second direct evaporative cooling device 214. The liquid cooling medium from the second liquid port 204 is transported to the load 4 after sequentially passing through the first direct evaporative cooling device 213 and the second direct evaporative cooling device 214, and then is circulated from the first liquid port 203 to the liquid flow path of one of the first dehumidification heat exchanger 12 and the second dehumidification heat exchanger 14 that is in a dehumidification operation, absorbing the adsorption heat generated. The ambient air B1 or alternatively a part of the airflow A4 from the air inlet can be introduced to the first direct evaporative cooling device 213 for heat and mass exchange with the liquid cooling medium and then be discharged. And, the airflow A4 (partially or entirely) from the air inlet is discharged after heat and mass exchange with the liquid cooling medium in the second direct evaporative cooling device 214. In the illustrated embodiment, a fourth pump 194 is provided between the first direct evaporative cooling device 213 and the second direct evaporative cooling device 214. In addition, due to the use of liquid cooling medium to cool the load 4, a machine room air treater 43 is arranged at the load 4, and the hot air flow for regeneration of the dehumidification heat exchanger is generated by using the ambient air B2 to exchange heat with the load 4 at the heat exchanger 44. It should be appreciated that the natural cooling device 2 in FIG. 3 or 4 is only illustrative, and in alternative embodiments, the natural cooling device 2 may have other suitable structures.

According to yet another aspect, FIG. 4 also illustrates a mechanical refrigeration device 5 in the cooling system, which is activated when the heat dissipation demand of the load 4 cannot be met when both the natural cooling device 2 and the pretreatment module 1 operate together. The mechanical refrigeration device 5 is a conventional compressor-based refrigeration loop, which includes a compressor 51, a condenser 52, a throttling device 53, and an evaporator 54 connected in sequence, wherein the evaporator 54 is used to cool the load 4. Therefore, the cooling system according to the embodiments of the present invention can operate in any of the natural cooling mode, auxiliary natural cooling mode, collaborative refrigeration mode, or mechanical refrigeration mode. In the natural cooling mode, only the natural cooling device 2 is in operation. In the auxiliary natural cooling mode, the pretreatment module 1 and natural cooling device 2 operate together. In the collaborative refrigeration mode, the pretreatment module 1, natural cooling device 2, and mechanical refrigeration device 5 operate together. In the mechanical refrigeration mode, the mechanical refrigeration device 5 operates alone. In some embodiments, the operating mode of the cooling system is determined based on ambient temperature and humidity. The enthalpy-humidity chart of humid air may include four regions corresponding to the four operating modes, where the mode to be executed is determined based on which region the actual ambient temperature and humidity locate in. In addition, in some embodiments, as shown in FIG. 3, the air heated by the load 4 can be mixed with the ambient air 101 before being transported to the first or second dehumidification heat exchanger to increase the flow amount of the airflow used for regeneration. In some embodiments, as shown in FIG. 4, the ambient airflow B2 heated by the load 4 can be adopted and transported to the first dehumidification heat exchanger or the second dehumidification heat exchanger after passing through the condenser 52 in the mechanical refrigeration device 5. Through this arrangement, the temperature of the airflow used for regeneration can be further increased when the condenser 52 is operating, thereby improving the speed and adequacy of regeneration, so as to remove the moisture absorbed by the dehumidification heat exchanger more quickly and thoroughly. Furthermore, the pretreatment module 1 can periodically switch between the first mode and the second mode when it is activated, where the switching frequency can be determined based on the ambient temperature and humidity, the temperature and humidity of regeneration air, the regeneration rate, the dehumidification effect and the like.

Figure 5:
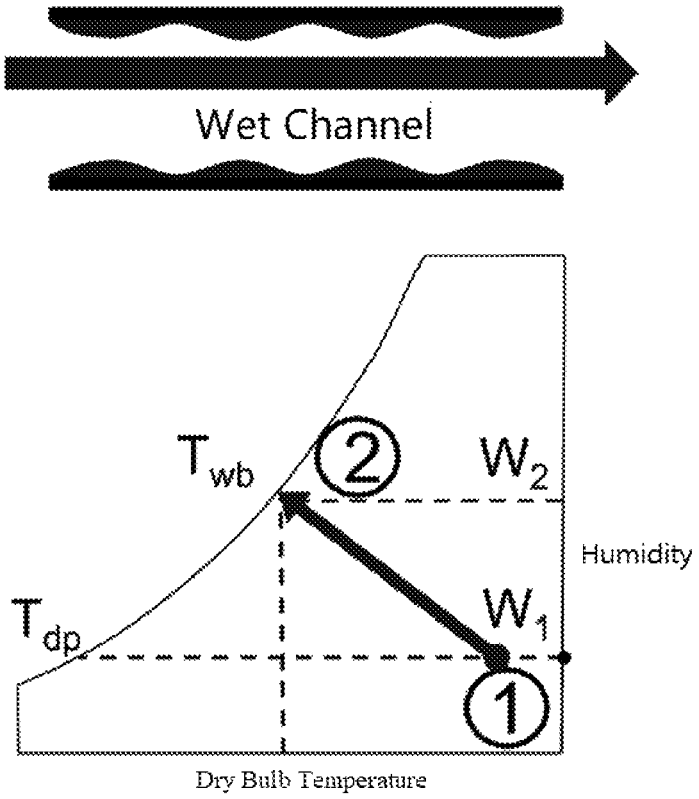
FIGS. 5 to 7 show the schematic diagrams of direct evaporative cooling and indirect evaporative cooling, as well as the temperature and humidity curves.
Figure 6:
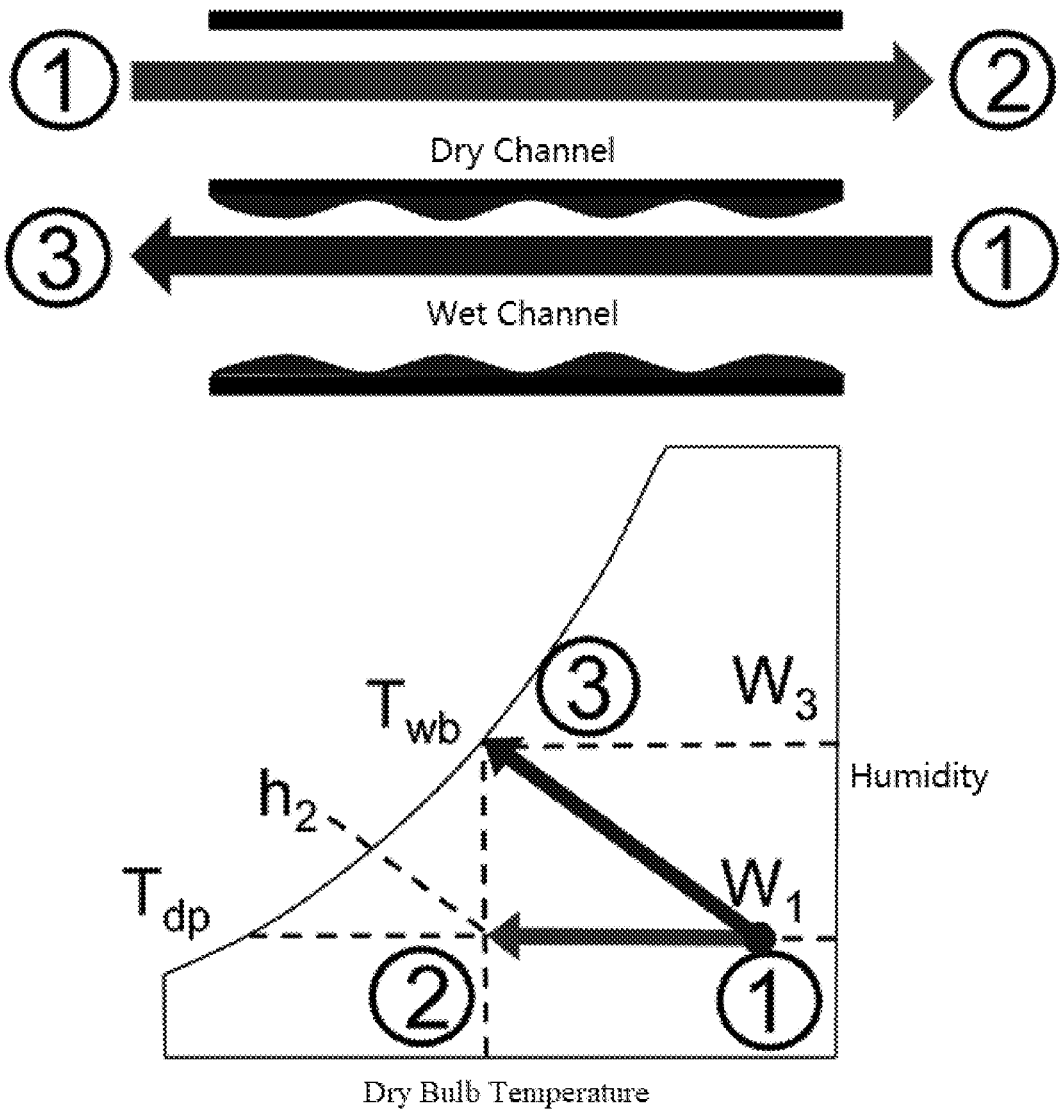
Figure 7:
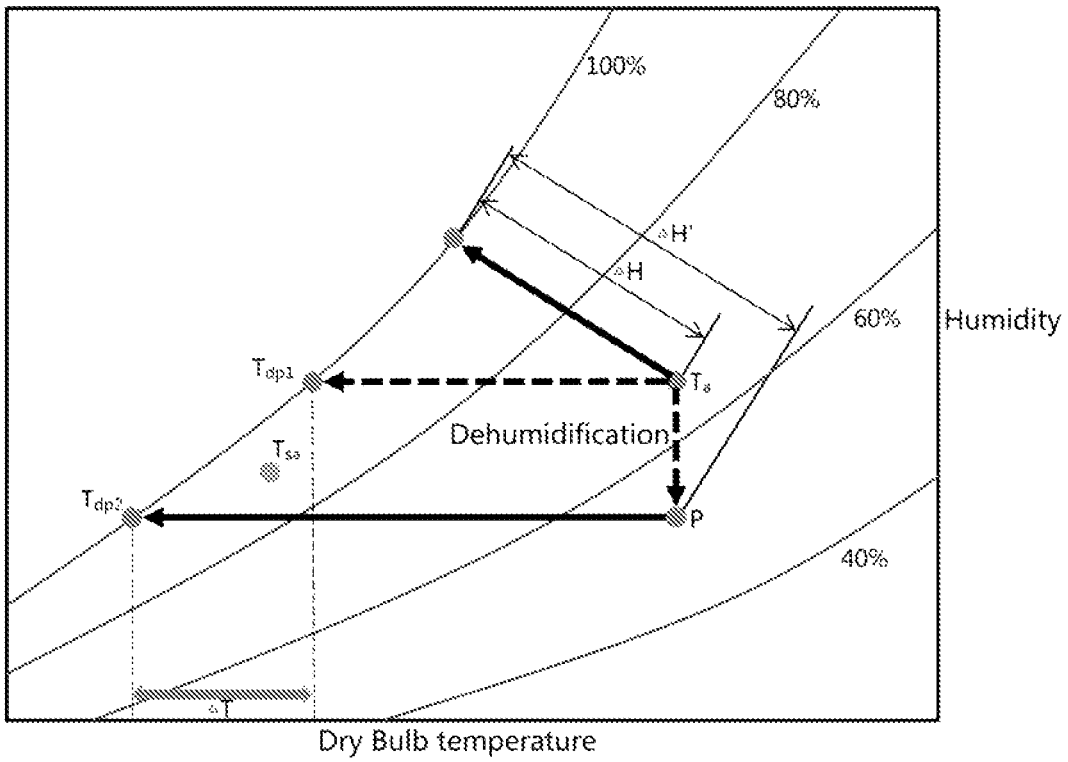

With continued reference to FIGS. 5 to 7, the principles of direct evaporative cooling and indirect evaporative cooling, as well as the impact of dehumidification on direct and indirect evaporative coolings are introduced. As shown in FIG. 5, direct evaporative cooling refers to the direct contact between air and cooling medium, such as water, in the pipeline, which can increase the humidity of the air and decrease its temperature, thus reaching the temperature $T_{wb}$ as shown by the arrow in the figure. With continued reference to FIG. 6, in indirect evaporative cooling, air and cooling medium, such as water, come into direct contact in the pipeline in a wet channel, which can increase the humidity and decrease the temperature of the air, while the airflow in another dry channel exchanges heat with the fluid in the wet channel, thereby reducing the temperature while keeping the humidity constant. The minimum temperature $T_{dp}$ that can be achieved through indirect evaporative cooling depends on the humidity of the airflow in the dry channel. Referring to FIG. 7, after dehumidification, the ambient air can be further reduced to a minimum temperature of $T_{dp2}$ from $T_{dp1}$ through indirect evaporative cooling. Similarly, the minimum temperature that can be achieved through direct evaporative cooling also decreases as a result of decreasing humidity. This enables the supply airflow with lower humidity to reach lower temperatures when using the same natural cooling device, which enables it to handle larger loads or higher ambient temperatures while the load remains constant. Specifically, when the temperature required for heat dissipation for the load is $T_{sa}$, the minimum temperature $T_{dp1}$ that can be achieved by indirect evaporative cooling of air without dehumidification treatment cannot meet the demand, while the minimum temperature $T_{dp2}$ lower than $T_{dp1}$ of the air after dehumidification treatment can meet the demand of the load. Therefore, by using the device according to the embodiments of the present invention, when as the ambient temperature rises, it is possible to use the natural cooling device as long as possible and activate the mechanical refrigeration device with higher energy consumption as late as possible, thereby reducing the overall energy consumption of the cooling system and improving its overall efficiency.

The specific embodiments described above in the present application are merely intended to describe the principles of the present application more clearly, wherein various components are clearly shown or described to facilitate the understanding of the principles of the present application. Those skilled in the art may, without departing from the scope of the present application, make various modifications or changes to the present application. Therefore, it should be understood that these modifications or changes should be included within the scope of patent protection of the present application.

What is claimed is:

1. A pretreatment module for a cooling system, comprising:

a first airflow path and a second airflow path, wherein the first airflow path is provided with a first dehumidification heat exchanger, and the second airflow path is provided with a second dehumidification heat exchanger;

a pipeline and valve assembly, wherein the pipeline and valve assembly is configured to be connected with a single air outlet of a natural cooling device of the cooling system; and wherein, the pipeline and valve assembly is configured to switch between a first mode and a second mode.

2. The pretreatment module according to claim 1, wherein the first dehumidification heat exchanger and the second dehumidification heat exchanger are arranged in parallel.

3. The pretreatment module according to claim 1, wherein the pretreatment module does not include a compressor.

4. The pretreatment module according to claim 2, wherein the pretreatment module does not include a compressor.

5. The pretreatment module according to claim 1, wherein in the first mode, the pipeline and valve assembly is configured such that the first airflow path communicates to an air inlet of the natural cooling device, and the second airflow path communicates to an air outlet of the natural cooling device.

6. The pretreatment module according to claim 1, wherein in the second mode, the pipeline and valve assembly is configured such that the first airflow path communicates with an air outlet, and the second airflow path communicates with an air inlet.

7. A cooling system for cooling a load, comprising:

a pretreatment module, the pretreatment module comprising:

a first airflow path and a second airflow path, wherein the first airflow path is provided with a first dehumidification heat exchanger, and the second airflow path is provided with a second dehumidification heat exchanger;

a pipeline and valve assembly, wherein the pipeline and valve assembly is configured to be connected with a single air outlet of a natural cooling device of the cooling system; and wherein, the pipeline and valve assembly is configured to switch between a first mode and a second mode; and a natural cooling device, the natural cooling device comprising:

a direct evaporative cooling device and/or an indirect evaporative cooling device.

8. The cooling system according to claim 7, wherein the pretreatment module and the natural cooling device are configured in series with the load.

9. The cooling system according to claim 7, further comprising a mechanical refrigeration device including a compressor.

10. The cooling system according to claim 7, wherein the natural cooling device comprises a direct evaporative cooling device and an indirect evaporative cooling device.

* * * * *